US010757982B2

(12) United States Patent
Kilbey

(10) Patent No.: US 10,757,982 B2
(45) Date of Patent: Sep. 1, 2020

(54) SURGICAL MODESTY GARMENT AND SUPPORT BRA

(71) Applicant: Bryan E. Kilbey, DeFuniak Springs, FL (US)

(72) Inventor: Bryan E. Kilbey, DeFuniak Springs, FL (US)

( * ) Notice: Subject to any disclaimer, the term of this patent is extended or adjusted under 35 U.S.C. 154(b) by 190 days.

(21) Appl. No.: 16/041,964

(22) Filed: Jul. 23, 2018

(65) Prior Publication Data

US 2020/0022421 A1 Jan. 23, 2020

(51) Int. Cl.

| | |
|---|---|
| ***A41C 3/06*** | (2006.01) |
| ***A41C 3/00*** | (2006.01) |
| ***A41C 3/02*** | (2006.01) |
| ***A41D 13/12*** | (2006.01) |
| *A41F 15/00* | (2006.01) |

(52) U.S. Cl.

CPC ..... *A41C 3/0064* (2013.01); *A41C 3/0028* (2013.01); *A41C 3/02* (2013.01); *A41C 3/06* (2013.01); *A41D 13/1245* (2013.01); *A41F 15/002* (2013.01)

(58) Field of Classification Search

CPC ..... A41C 3/0064; A41C 3/0028; A41C 3/02; A41C 3/06; A41D 13/1245; A61F 5/03

USPC ..... 450/76

See application file for complete search history.

(56) References Cited

U.S. PATENT DOCUMENTS 1,420,248 A * 6/1922 Fay ..... A41C 3/06 450/66
2,443,127 A * 6/1948 Gutsmann ..... A41C 3/06 450/41
3,968,803 A * 7/1976 Hyman ..... A61F 13/145 602/79
5,152,741 A * 10/1992 Farnio ..... A41C 3/0064 450/1
5,538,502 A * 7/1996 Johnstone ..... A41C 3/0064 450/1
6,135,975 A * 10/2000 Johnstone ..... A41C 3/0064 602/19
6,464,717 B1 * 10/2002 Smith ..... A61F 7/02 450/58
2004/0002288 A1 * 1/2004 Bell ..... A41C 3/0064 450/75
2006/0046615 A1 * 3/2006 Zecher ..... A41C 3/0057 450/58
2008/0287036 A1 * 11/2008 McGuire ..... A41C 3/0057 450/23
2012/0142253 A1 * 6/2012 Javaid ..... A41C 3/04 450/80

* cited by examiner

*Primary Examiner* — Gloria M Hale
(74) *Attorney, Agent, or Firm* — J. Wiley Horton

(57) ABSTRACT

A modular brassiere that serves as both a modesty garment and an easily-donned support garment. The modular bra includes an elongated support band that is preferably made of elastic material. Hook-and-loop type of engaging panels are used to secure the band around the user's chest. A separate strap assembly may be added to transfer load to one or more of the user's shoulders. The support band includes a proximal end and a distal end. A pocket is preferably included, proximate the distal end. The user can place one or more fingers into this pocket to assist in donning the device. A grip panel is preferably included as well. The grip panel includes a strap loop which the user can employ to also assist in donning the device.

20 Claims, 15 Drawing Sheets

SURGICAL MODESTY GARMENT AND SUPPORT BRA

FIELD OF THE INVENTION

This invention relates to the field of medical products. More specifically, the invention comprises a modular brassiere configured to address patient modesty concerns while allowing access for a variety of surgical procedures. The inventive brassiere may also be worn after surgery in place of a conventional brassiere.

DESCRIPTION OF THE RELATED ART

Shoulder surgeries are now most often performed using minimally invasive techniques. Even so, the shoulder area must often be fully accessible to allow the selection of suitable entry points and mobilization of the joint. Patients are conventionally prepped by covering with a sterile drape until anesthetized. The drape is then folded or cut away from the area of the shoulder and taped or otherwise secured in place.

Patient modesty concerns are now a significant topic in the surgical community. Many patients—particularly female patients—wish to know which portions of the body are exposed during a procedure. Conventional drapes often leave exposed portions of the anatomy that would otherwise be covered, for female patients in particular, surgical drapes often expose the chest during shoulder procedures.

In addition, surgeons often wish to minimize the use of any type of strap over the shoulder surgery site. Conventional brassieres cannot be worn for a significant time period following a procedure. The present invention seeks to cover the chest area while leaving the shoulder fully accessible for shoulder surgeries. The present invention often serves as a brassiere that eliminates the use of a strap proximate the surgical site.

BRIEF SUMMARY OF THE PRESENT INVENTION

The present invention comprises a modular brassiere that serves as both a modesty garment and an easily-donned support garment. The modular bra includes an elongated support band that is preferably made of elastic material. Hook-and-loop type engaging panels are used to secure the band around the user's chest. A specialized strap assembly may be added to transfer load to the user's non-surgical shoulder.

The support band includes a proximal end and a distal end. A pocket is preferably included, proximate the distal end. The user can place one or more fingers into this pocket to assist in donning the device. A grip panel is preferably included as well. The grip panel includes a strap loop which the user can employ to also assist in donning the device.

REFERENCE NUMERALS IN THE DRAWINGS

Figure 1A:
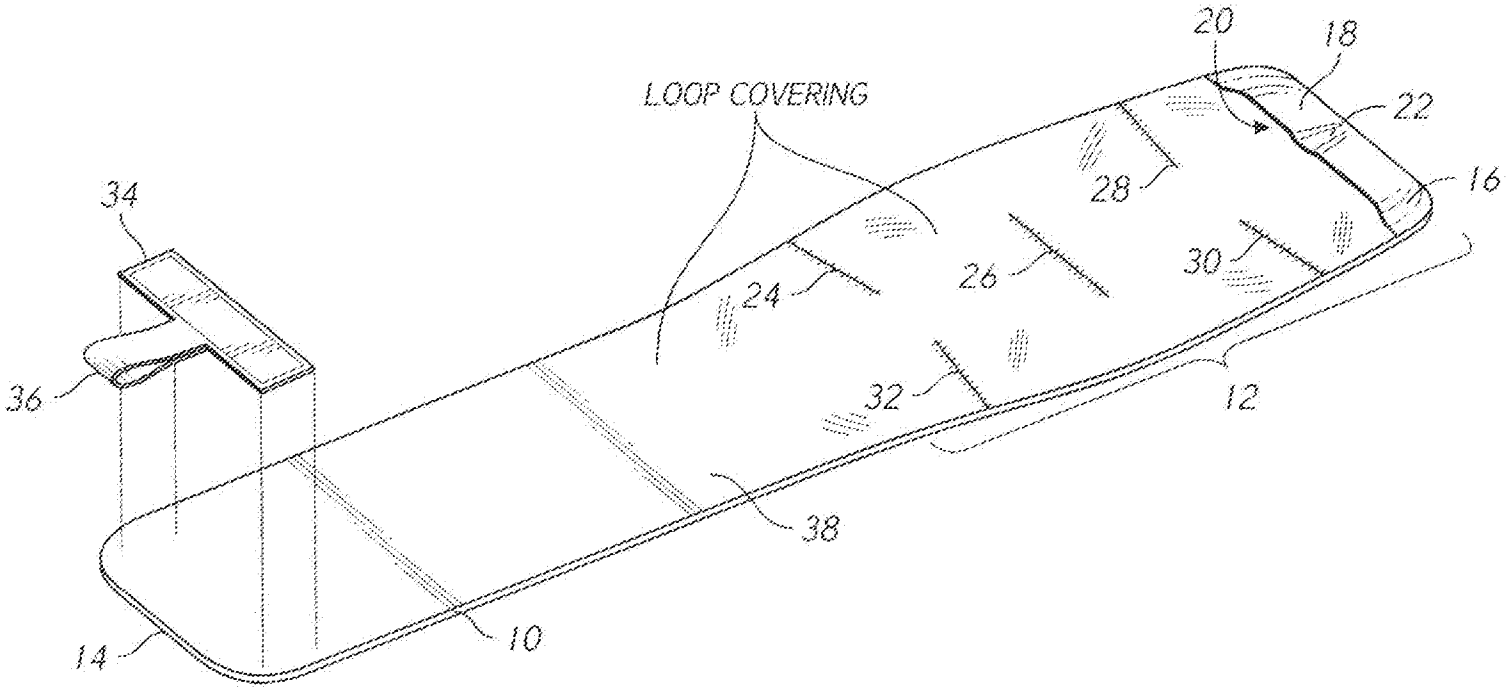
FIG. 1A is a perspective view, showing the inventive support band.

10 support band
12 broadened section
14 proximal end
16 distal end
18 pocket
20 pocket opening
22 divider
24 stitched seam
26 stitched seam
28 stitched seam
30 stitched seam
32 stitched seam
34 grip panel
36 strap loop
38 outward facing surface
40 inward facing surface
42 flat pattern
44 relief notch
46 relief notch
48 relief notch
50 relief notch
52 cup
54 cup
55 center relief
56 hook panel
58 hook panel
60 removed section
62 strap assembly
64 first strap
66 second strap
68 third strap
70 fourth strap
72 hook panel
74 hook panel
76 hook panel
78 hook panel
80 outward facing surface
82 inward facing surface
84 removed section
86 operative shoulder
88 non-operative shoulder

DETAILED DESCRIPTION OF THE INVENTION

FIG. 1A is a perspective view illustrating most of the components of the present invention. Support band 10 is preferably made of an elastic material that can stretch longitudinally and laterally. Outward facing surface 38 is covered in hook-compatible material meaning a material to which a Velcro-type hook panel will adhere. This is denoted as "loop covering" in the drawings. However, this does not necessarily mean a loop "pile" that tends to attract debris. Those skilled in the art will know that there are presently available hook-compatible materials having a smooth surface. Outward-facing surface 38 is preferably such a smooth surface.

Broadened section 12 is configured to cover the user's anterior chest. In the particular embodiment shown, stitched seams 24, 26, 28, 30, and 32 are provided to create a three-dimensional shape for broadened section 12. As will be explained more fully in this disclosure, the three-dimensional shape is configured to create a pair of "cups" as are found in a traditional bra.

Distal end 16 preferably includes pocket 18 having a pocket opening 20. Divider 22 may be furnished to divide the pocket opening into two portions. The pocket may be easily created by stitching a separate panel of fabric to support band 10 and the divider may be created by stitching as well.

In the example shown grip panel 34 is provided as a separate, detachable piece. It is intended to be placed somewhere near proximal end 14, but its precise location may be varied to suit a particular users anatomy. Grip panel 34 has a hook panel on its underside (from the vantage point of the viewer in FIG. 1A), this hook panel can be used to secure grip panel to outward facing surface 38 of support band 10. Strap loop 36 is provided for the users finger or thumb as will be explained subsequently.

Figure 1B:
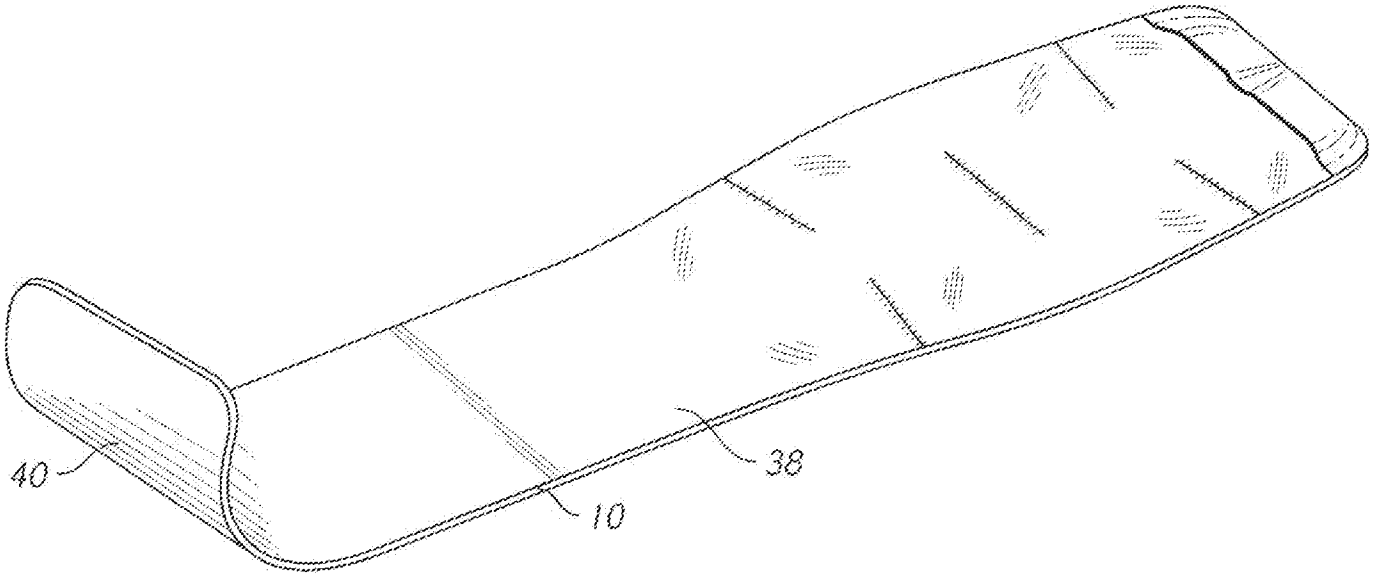
FIG. 1B is a perspective view, showing the support band of FIG. 1A with the proximal end curled over.

FIG. 1B shows support band 10 with its proximal end lifted to show inward facing surface 40. Inward facing surface 40 will in most cases bear directly against the user's skin. Accordingly, it is preferable to cover inward facing surface 40 with a breathable material having a pleasant feel. The support band in the preferred embodiments is made of at least two elastic layers. The inner layer is breathable, elastic, and pleasant feeling. The outer layer is also preferably breathable and elastic. The outer layer will not bear against the user's skin. However, it is desirable for at least a significant portion of the outward facing surface of the outer layer should be hook compatible.

Figure 2:
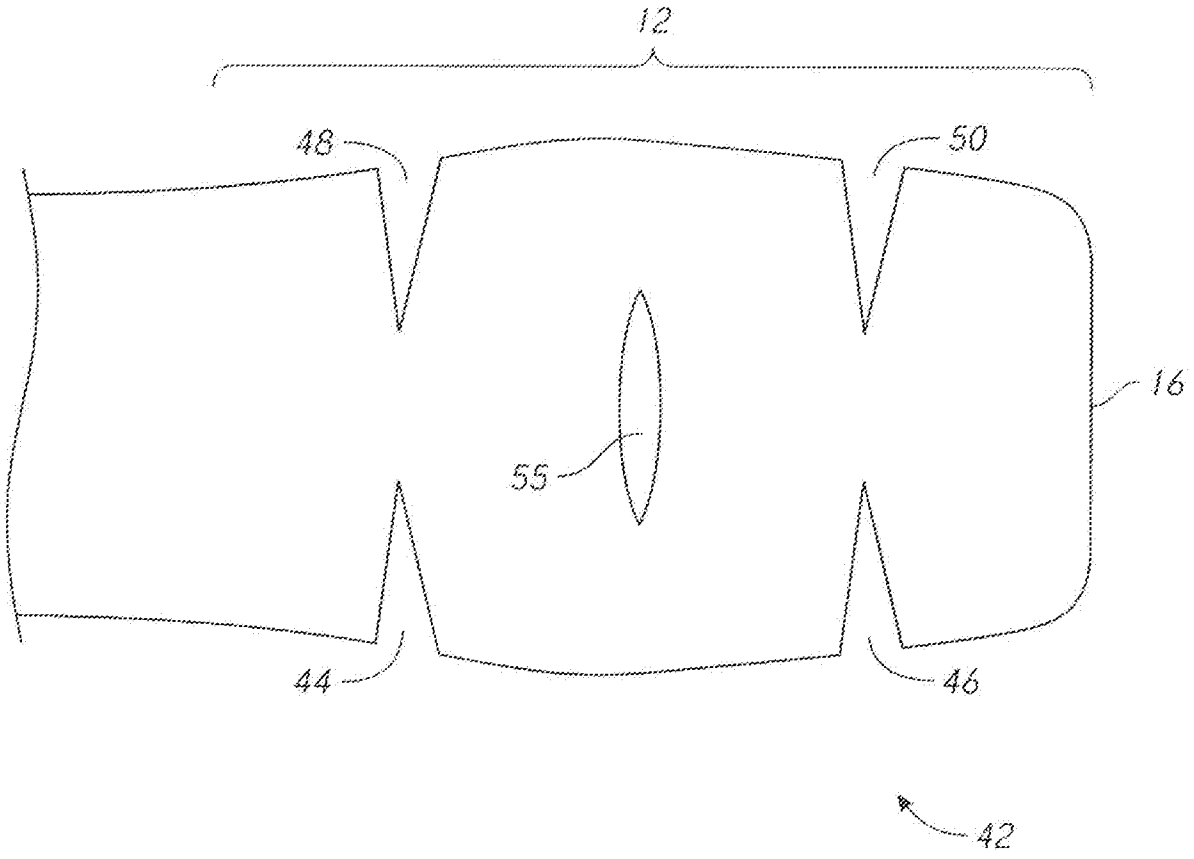
FIG. 2 is a plan view, showing a flat pattern that may be used to create the inventive support band.

Returning briefly to FIG. 1A, the reader should note that in this embodiment the three-dimensional configuration of broadened section 12 is created by stitching together some scams on a flat pattern. FIG. 2 depicts a flat pattern 42 that can be used to create this shape. Only broadened section 12 shown in the view. Relief notches 44, 46, 48, and 50 are cut in the edges of the material. Center relief 55 is cut in the center. Each of these notches or reliefs has a pair of lateral edges that can be joined together. One method of joining the lateral edges is to stitch them together. They may also be joined by ultrasonic welding or the use of fabric adhesive.

Figure 3:
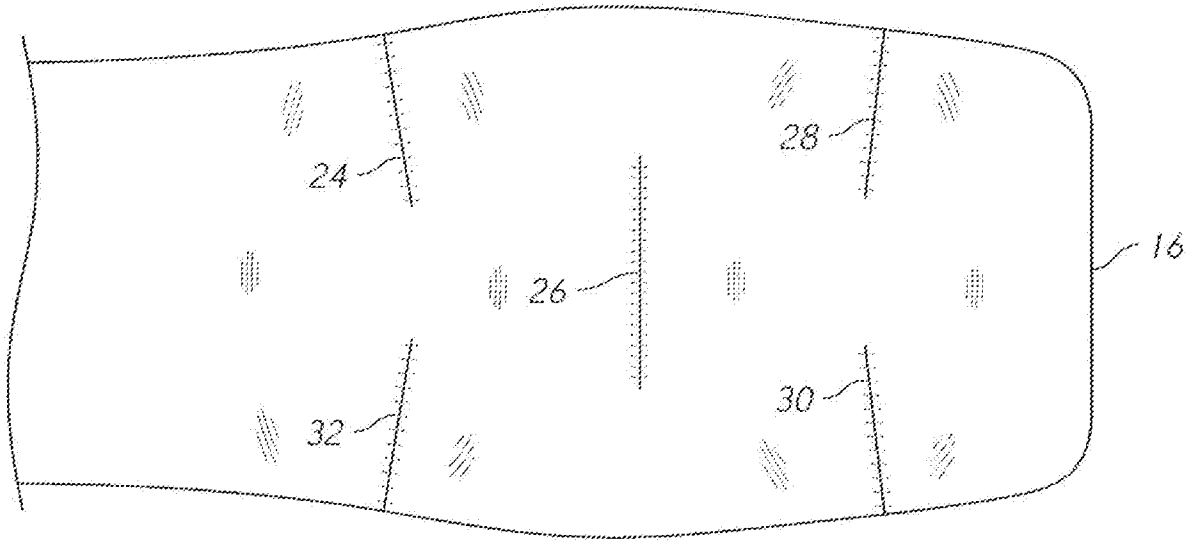
FIG. 3 is a plan view, showing the flat pattern of FIG. 2 after the seams have been joined.

FIG. 3 shows the broadened section after the sides of the relief notches and center relief have been joined together to create stitched seams 24, 26, 28, 30, and 32. As those skilled in the art will realize, the joining of the sides of the relief notches and center relief creates a three-dimensional configuration in which the areas proximate stitched seams 24, 28, 30, and 32 protrude toward the user (from the vantage point of FIG. 3). The region of stitched seam 26 lends to be pulled flat.

Figure 4:
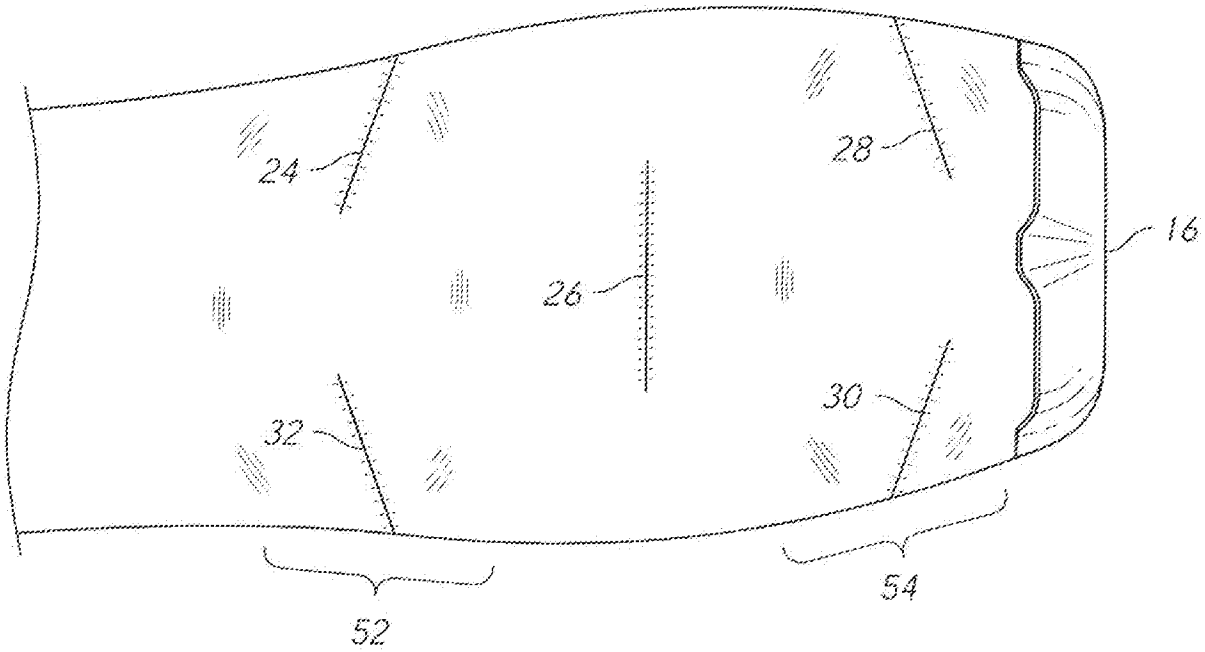
FIG. 4 is a perspective view, showing some details of the distal end of the support band.

FIG. 4 shows a perspective view after the stitched seams have been joined. The protruding areas create cup 52 and cup 54, which are configured to serve the same purpose as the cups found in a conventional bra. Because the material employed is able to stretch in two directions, a single cup configuration can serve a wide variety of anatomical types.

As those skilled in the art will know, the use of a flat pattern and stitched seams is not the only way to create a suitable three-dimensional shape. A bra cupping machine can be used to form a suitable three-dimensional shape by deforming a suitable material plastically. The present invention is not limited to any particular method of creating a suitable three-dimensional cup shape.

Figure 5A:
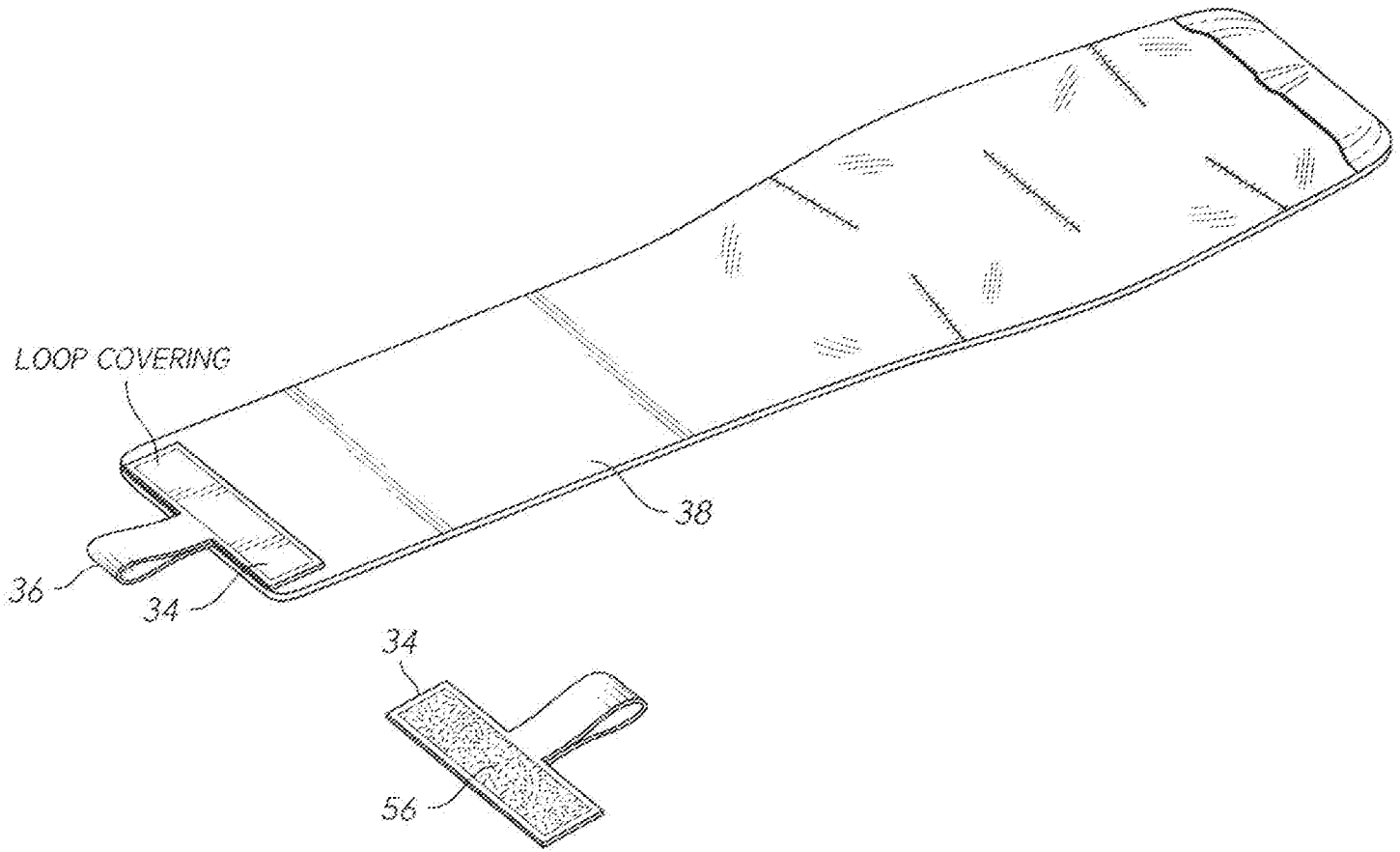
FIG. 5A is a perspective view, showing how the grip panel can be attached to the support band.

FIG. 5A shows the support band with outward facing surface 38 visible. A single grip panel 34 is provided. Two examples of grip panel 34 are shown in the view. The one shown detached from the support band is flipped over to reveal hook panel 56 on its underside. The grip panel 34 that is attached to the support band is attached by pressing the hook panel on its underside (not visible in the view) against the loop compatible material on outward facing surface 38. Once pressed into this position, grip panel 34 becomes securely attached to the support band. Strap loop 36 then protrudes outward from the proximal end as shown.

The reader will observe that the outward facing side of grip panel 34 (as it sits attached to the support band) is provided with a panel of loop covering (meaning a hook compatible material). This panel of loop covering facilitates the attachment of the band.

Figure 5B:
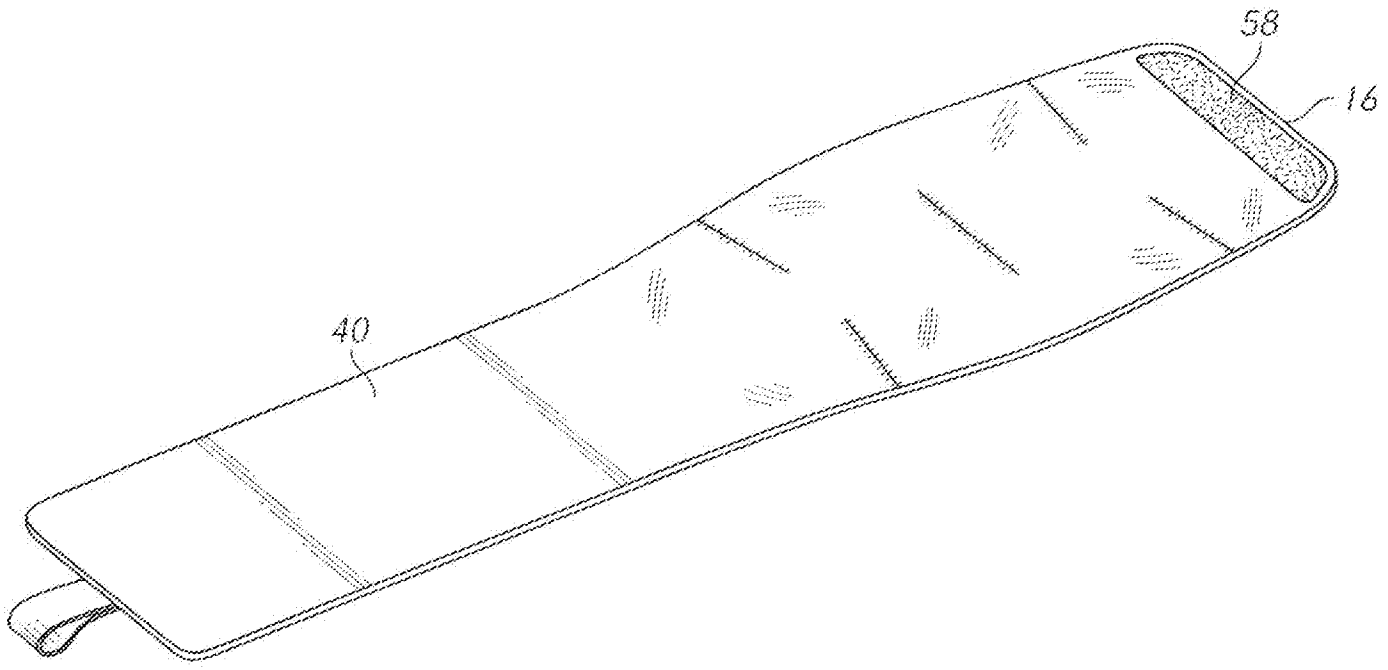
FIG. 5B is a perspective view, showing the inward facing surface of the support band.

FIG. 5B shows the assembly of FIG. 5A flipped over to reveal inward facing surface 40. Distal end 16 of the support band includes hook panel 58. This hook panel is used to secure the support band back to itself, as will be explained subsequently.

Figure 6:
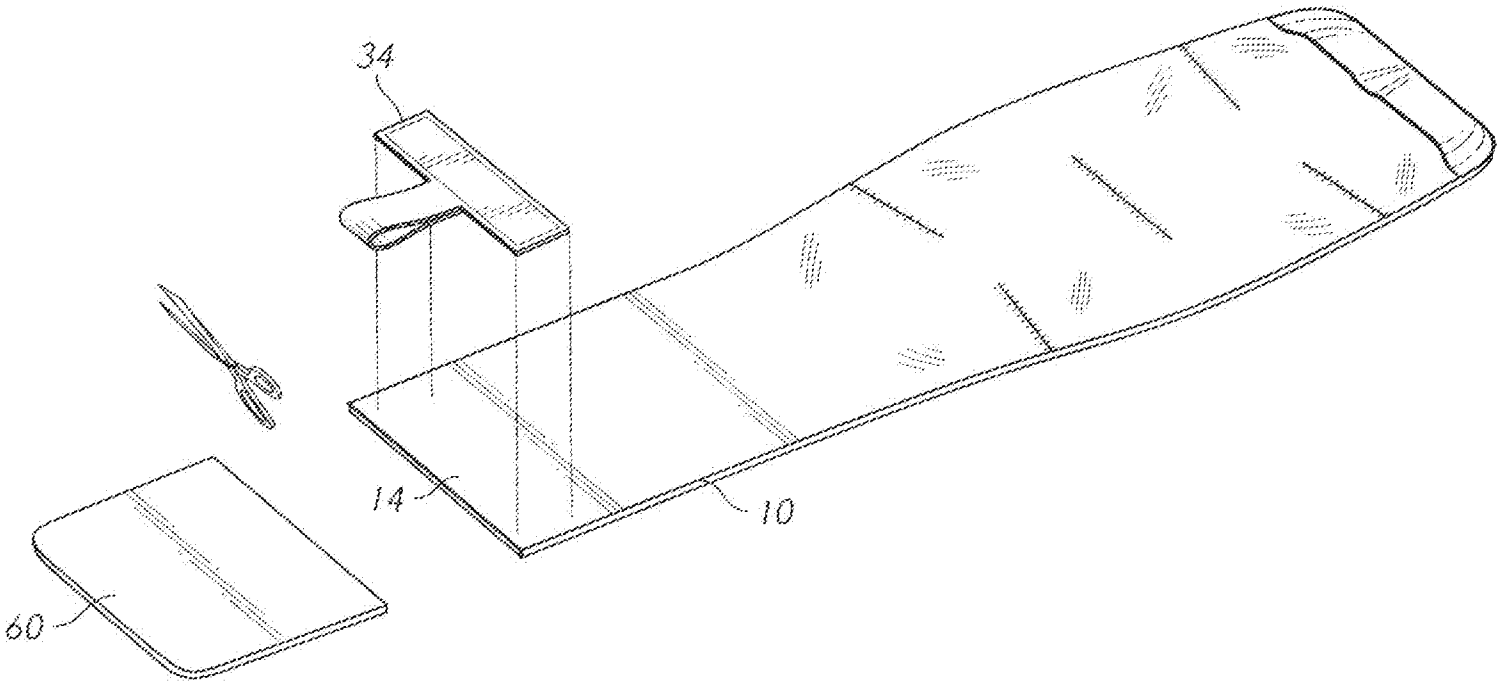
FIG. 6 is a perspective view, showing how the length of the support band can be reduced to suit a particular patient.

It is preferable to provide the inventive support band as a "universal" size that can then be cut to length to suit individual users. FIG. 6 illustrates the process of cutting the band to length. Once a suitable length has been determined, a pair of scissors or other cutting instrument is employed to detach removed section 60—and thereby create a relocated proximal end 14. Grip panel 34 is then pressed into position on the new proximal end.

Figure 7:
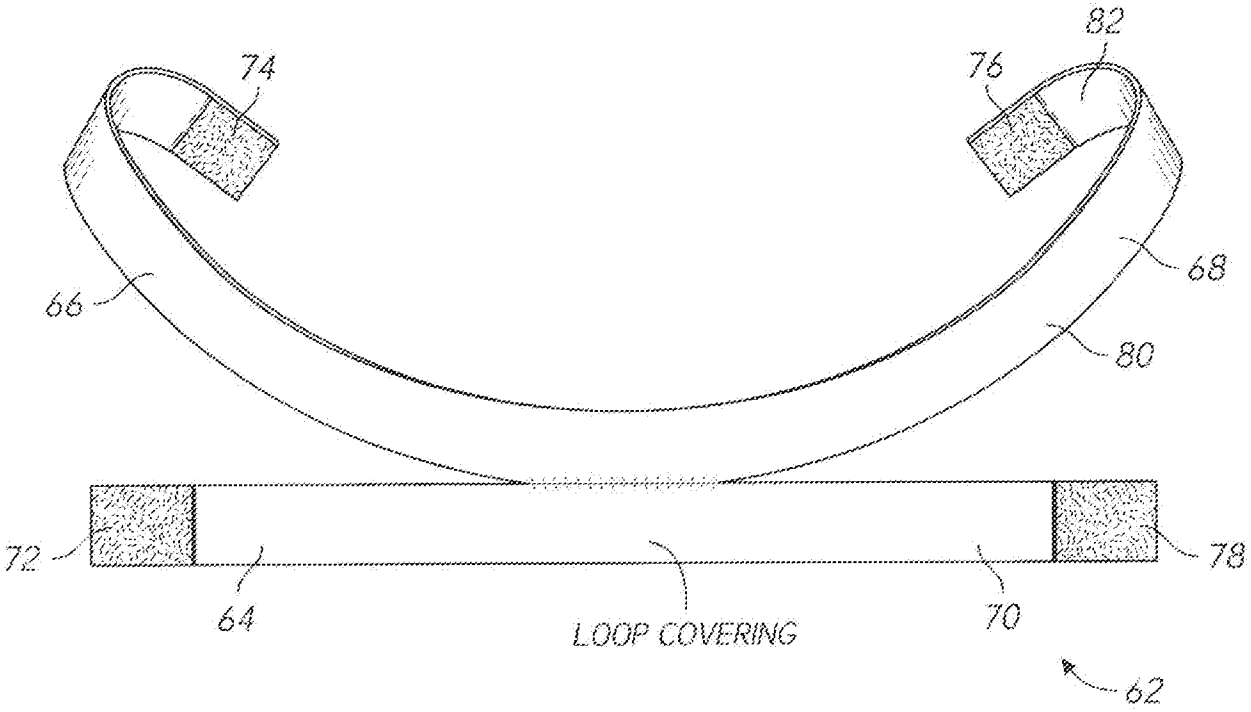
FIG. 7 is an elevation view, showing a strap assembly that can be added to the support band.

Many users will wish to employ a strap system in conjunction with the support band. FIG. 7 shows an elevation view of an embodiment of strap assembly 62. Patients undergoing shoulder surgery will have an "operative" shoulder (the shoulder on which surgery is to be performed) and a "non-operative" shoulder (the other shoulder). The strap assembly shown is designed to place the load of the straps on the non-operative shoulder and to leave the operative shoulder free. The strap assembly shown is also designed to be placed over the left shoulder or the right shoulder (depending upon which shoulder needs to be free). Thus, the terminology used to describe the strap assembly components will not use directional terms such as "left" or "right." This reflects the fact that the orientation of the strap assembly can be reversed as needed.

In the embodiment shown, four separate straps extend outward from a central junction. These are: first strap 64, second strap 66, third strap 68, and fourth strap 70. The straps are made of an elastic material having an inward facing surface 82 and an outward facing surface 80. The inward facing surface is preferably soft and breathable (as it will bear against the user's skin). The outward facing surface is preferably covered in hook compatible material. A hook panel 72, 74, 76, 78 is connected to the end of each strap by pressing hook-and-loop type hooks on each hook panel into the hook compatible material on the outward facing surface of each strap.

Figure 8:
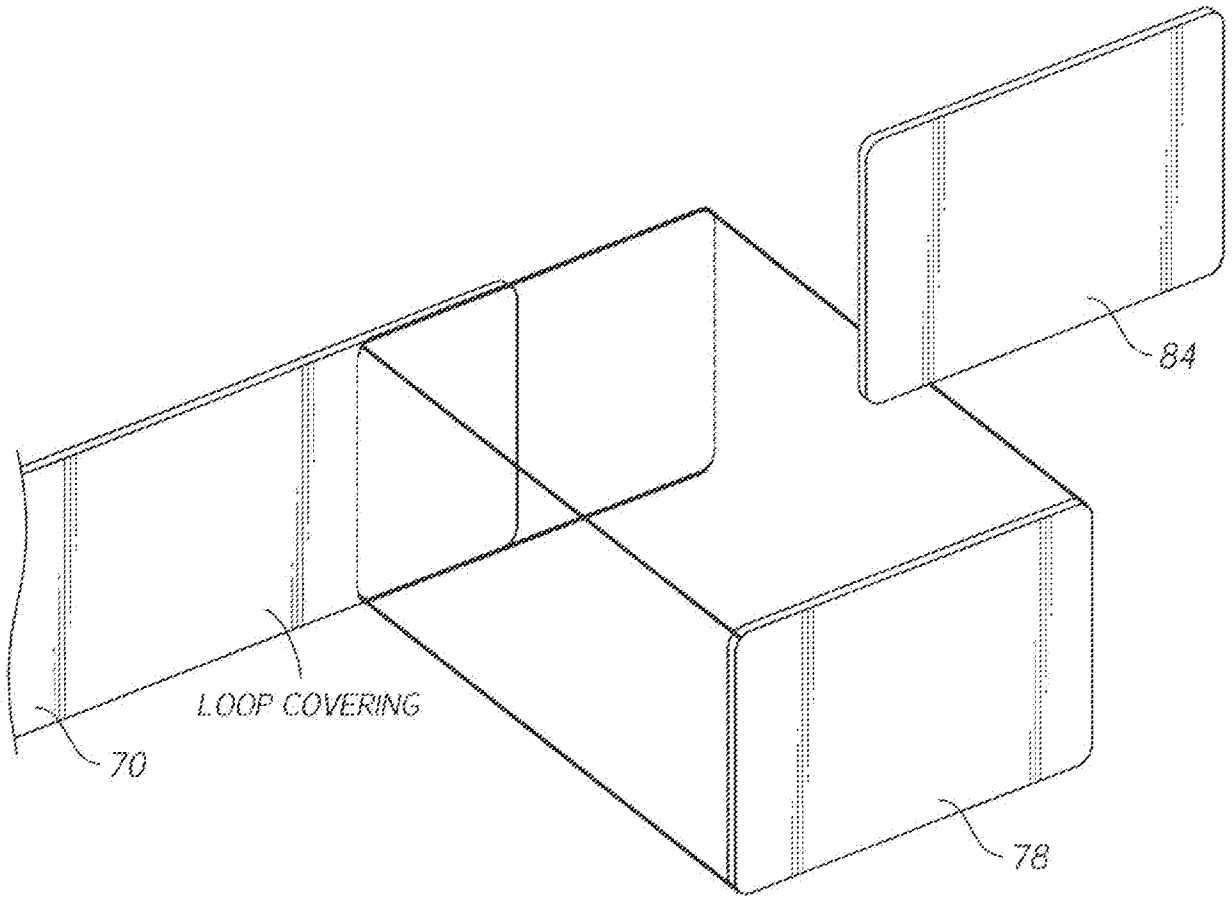
FIG. 8 is a detailed view, showing how the strap assembly can be cut to fit.

The strap system is preferably made of a material that can be cut to a desired length. FIG. 8 shows the process of cutting free removed section 84 and adjusting the position of hook panel 78. The concept is to have each hook panel extend beyond the end of the strap to which it is attached. This configuration allows some of the hooks on each hook panel to engage another hook-compatible surface, thereby attaching the end of the strap to the other surface.

FIGS. 9 through 12 illustrate how the inventive support garment is placed on a user. The support is designed to be self-donned, though it can obviously be applied by a health care provider as well. The inventive support garment is intended to be wearable in a left-handed or right-handed configuration. One can change from left-handed to right-handed by flipping it over.

Figure 9:
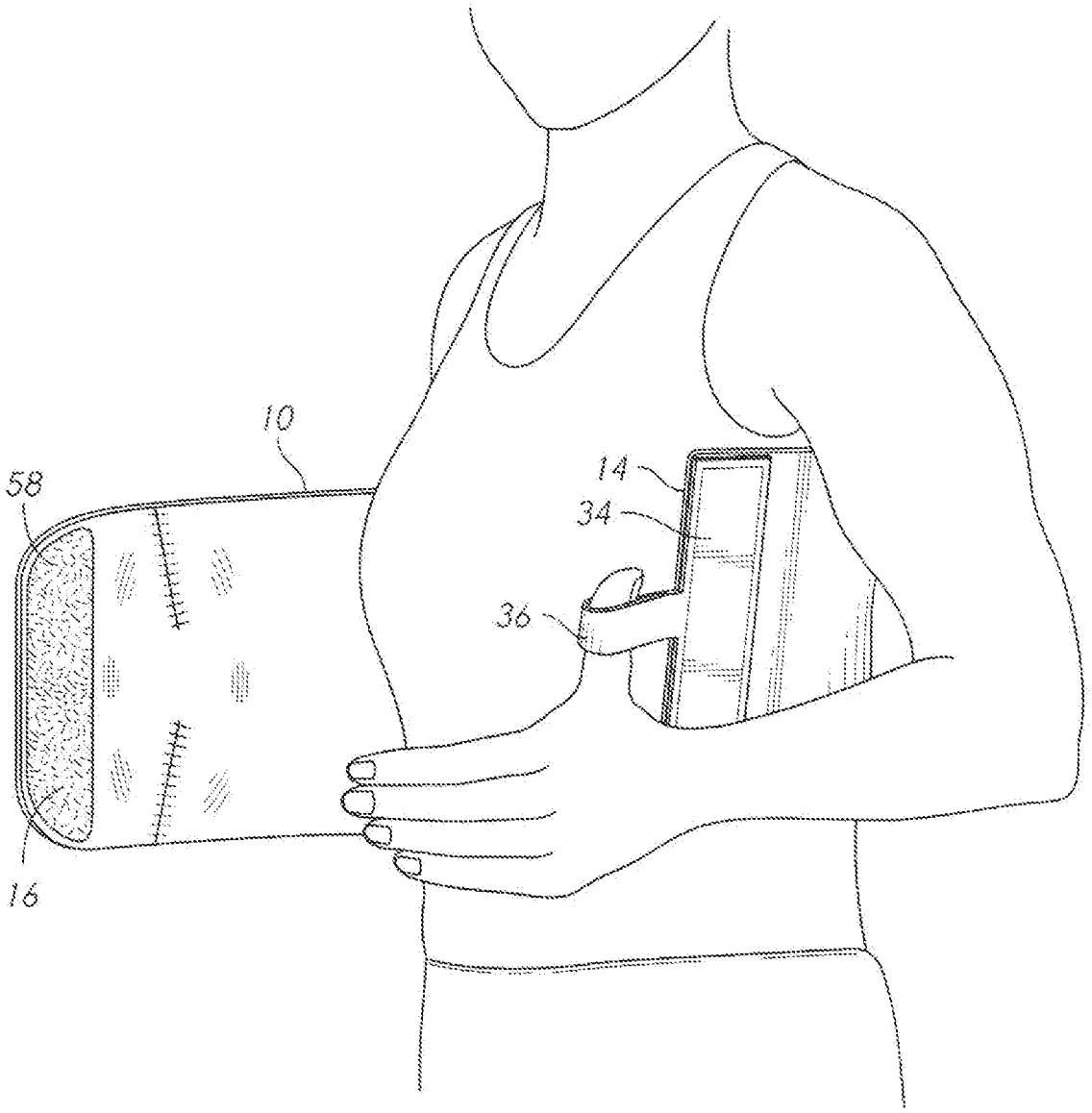
FIG. 9 is a perspective view, showing a patient donning the inventive support band.

In FIG. 9 the user is wearing an undershirt. In many instances support band 10 will be applied directly to the skin with no undershirt. In the example of FIG. 9, the operative shoulder is the user's left shoulder. The reader should bear in mind that the inventive garment will likely be used after surgery during the recovery phase. In this phase it is generally undesirable for the patient to reach rearward using the operative shoulder. Suited another way, it is undesirable for the patient to move the elbow on the operative side significantly rearward of the torso or to move the elbow away from the torso. The invention is designed with these constraints in mind.

As shown in FIG. 9, the user passes support band 10 around her waist and hooks her left thumb through strap loop 36 on grip panel 34. The position shown allows the user to hold proximal end 14 without having to significantly move the operative shoulder. She places the thumb and fingers of her right hand in the pocket on the outward facing side of distal end 16. She then pulls the hand upward to a position underneath the armpits as shown. The reader should recall that the band is made of elastic material and can be stretched to a desired length.

Figure 10:
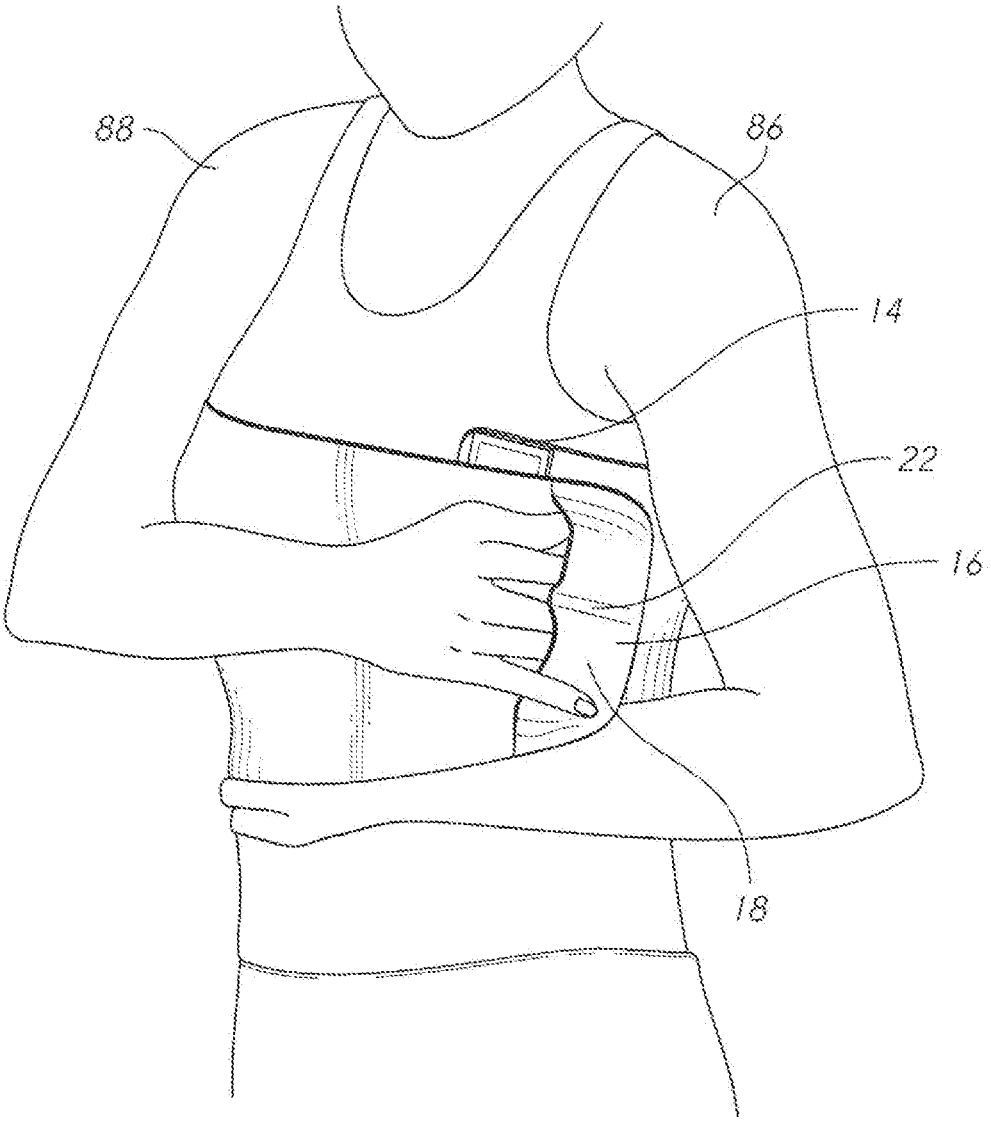
FIG. 10 is a perspective view, showing a patient donning the inventive support band.
Figure 11:
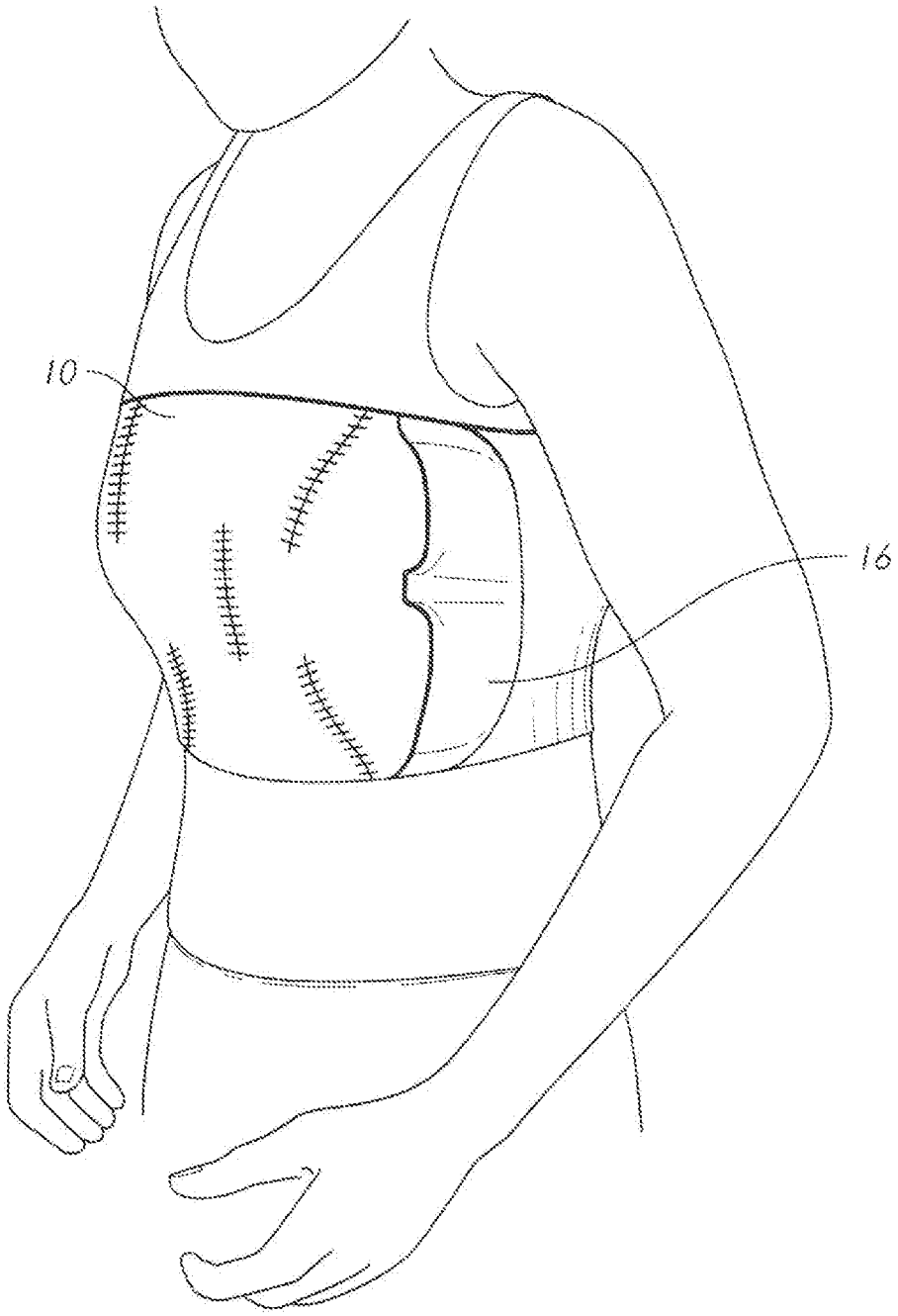
FIG. 11 is a perspective view, showing a patient donning the inventive support band.

In FIG. 10, the user has wrapped her right hand over the position of grip panel 34 and pressed the hook panel on the inward facing side of distal end 16 against the hook-compatible material on proximal end 34. Support band 10 has thereby been secured to itself. She can then remove her right hand front pocket 18 and slide her left hand out from under the support band. In this view the reader will observe that the significant motion required to attach the garment has been performed using non-operative shoulder 88 rather than operative shoulder 86. The user may then wish to grasp the encircling support band and pull it up to a snug position as shown in FIG. 11 (using the hand of her non-operative shoulder).

Figure 12:
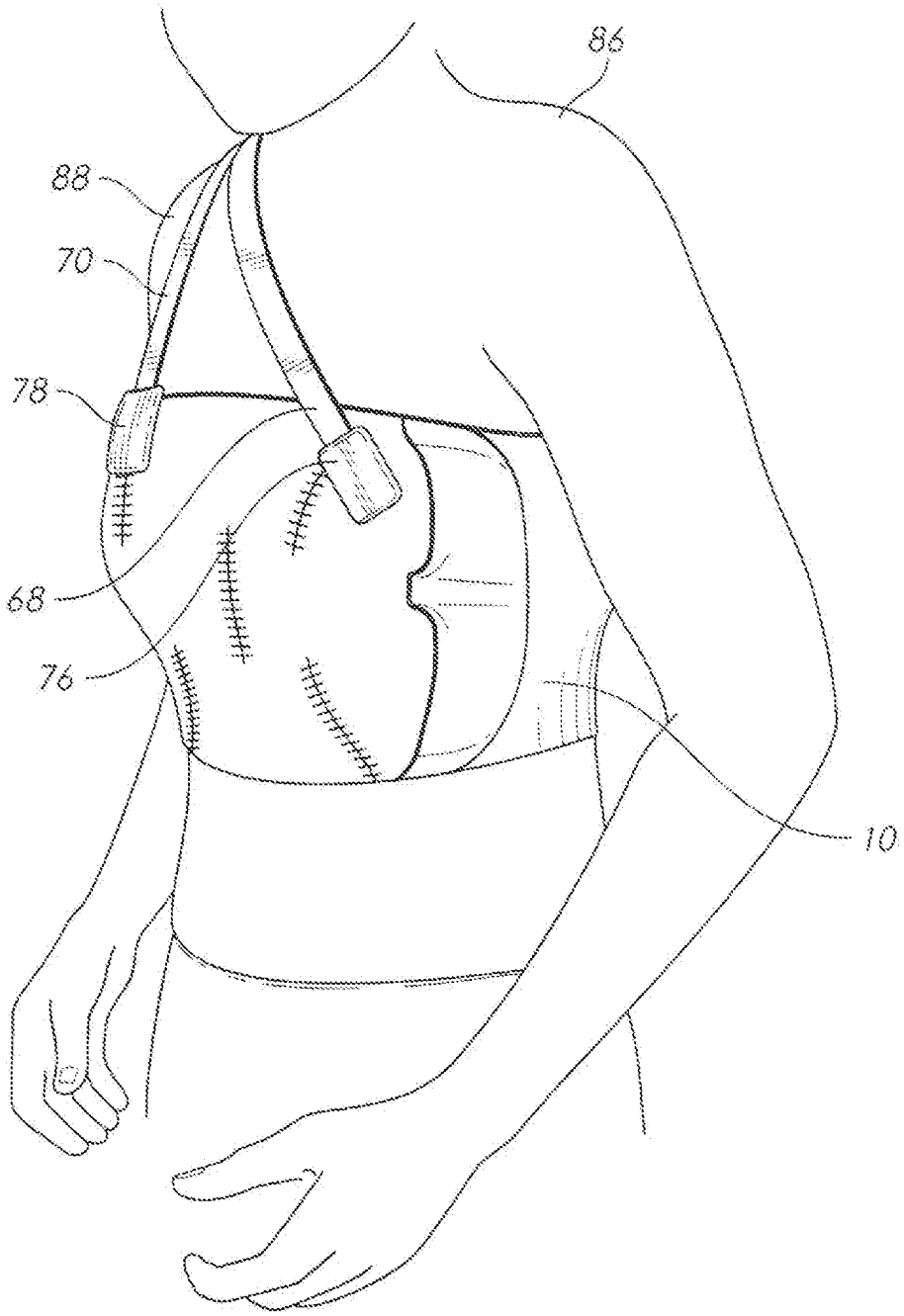
FIG. 12 is a perspective view, showing the inventive support band with the addition of a strap assembly when configured for a left shoulder surgery.

FIG. 12 shows the same configuration with the addition of a strap assembly. In this example the non-operative shoulder is the patient's right shoulder. It is this shoulder that should carry the strap load. Third strap 68 is passed over the right shoulder (non-operative shoulder) and secured to the from of support band 10 with hook panel 76. Fourth strap 70 is likewise secured to the front of the support band using hook panel 78. Returning briefly to FIG. 7, the reader will recall that strap assembly 62 has first strap 64 and second strap 66 as well. These other two straps are also secured to the support band in the configuration shown in FIG. 12, with the free ends of the lower straps being secured to the posterior portions of the support band as it appears in FIG. 12. Owing to the vantage point of FIG. 12 these other straps are not visible.

Looking again at FIG. 7, the reader should note that some embodiments of the strap assembly use only two straps and still others may use three straps or some other number of straps. The goal is to provide support using the non-operative shoulder and other configurations can suit this goal.

Figure 13:
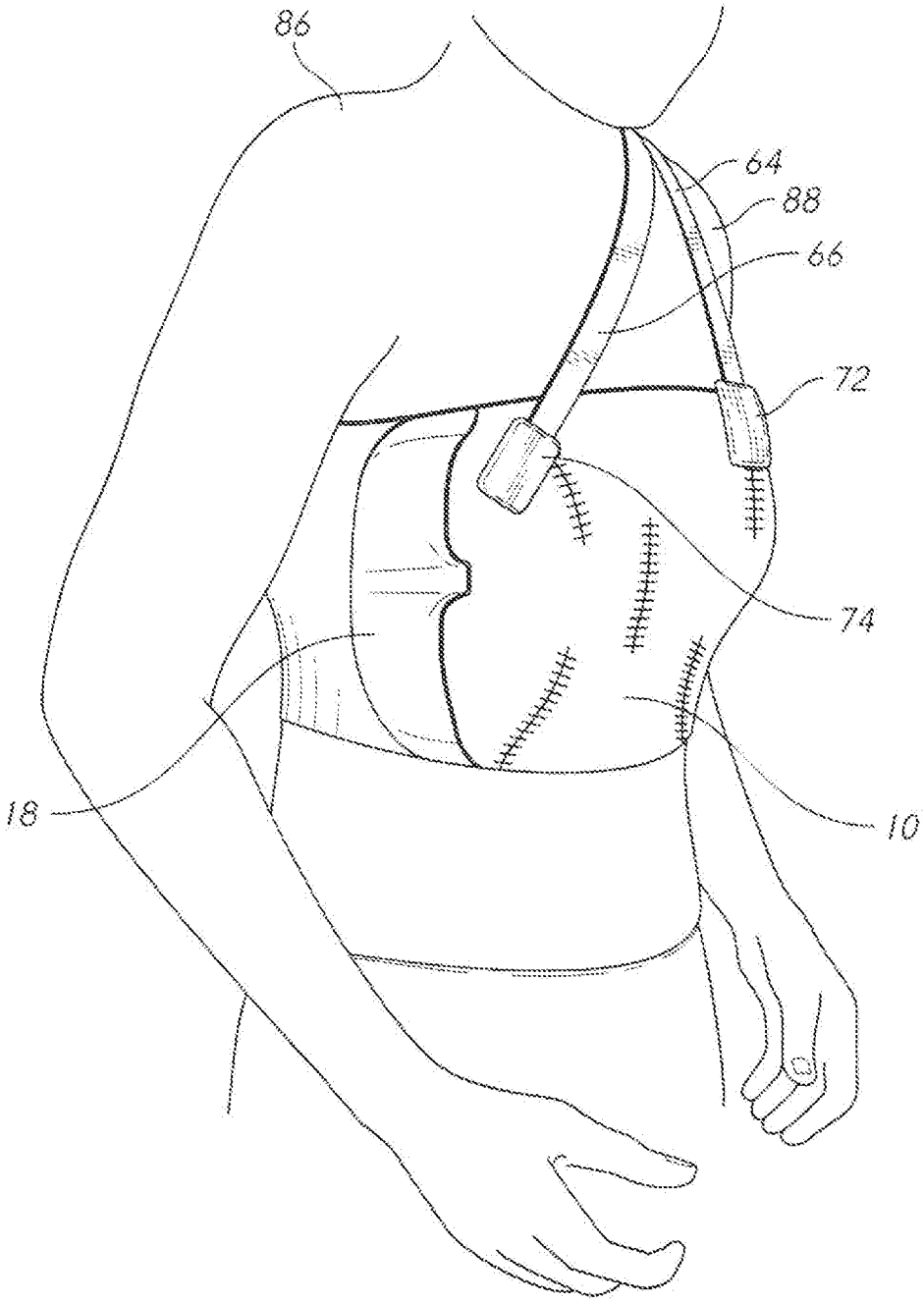
FIG. 13 is a perspective view, showing the inventive support band with the addition of a strap assembly when configured for a right shoulder surgery.

FIG. 13 shows the inventive garment configured for use where the patient's right shoulder is the operative shoulder 86 and the patient's left shoulder is the non-operative shoulder 88. In this version first strap 64 and second strap 66 extend from the region of the patient's left shoulder and connect to the band using hook panel 72 and hook panel 74. The donning of the garment is the same as described for FIGS. 9-12, except that the operation resulting in the configuration shown in FIG. 13 is the mirror of the operation shown in FIGS. 9-12.

The inventive garment can serve many purposes, including acting as a "modesty" garment during shoulder surgery and as a support garment both before and after surgery. FIGS. 12 and 13 show a configuration that is suitable for surgery. Support brace 10 is placed over the patient's naked upper body. The garment may actually be donned by the patient herself in a pre-surgical waiting area. The garment is comfortable to wear and provides the support of a conventional bra. Depending on the patient's progress post-surgery, the inventive support brace can be worn in place of a conventional bra. As those skilled in the art will know, shoulder surgery patients have limited shoulder mobility for some period. Thus, it is preferable to provide a support garment that can be donned with a shoulder having limited mobility.

In the configuration of FIG. 9, the assumption is that the patient's left shoulder has limited mobility. Once she places her thumb in strap loop 36, she can leave her left shoulder in the braced position shown and use the motion of her right shoulder to loop the support band into position and secure it.

For a patient having limited mobility on her right shoulder, the donning process would be reversed. The inventive garment would be flipped upside down so that the thumb other right hand is through strap loop 36. She would then user the mobility of her left shoulder to loop the support band into position.

Although the preceding descriptions present considerable detail they should be properly viewed as illustrating embodiments of the present invention rather than limiting the scope of the invention. Many more embodiments following the same principles will occur to those skilled in the art. Accordingly, the scope of the invention should be fixed by the following claims rather than by the examples given.

The invention claimed is:

1. A support garment suitable for use in a surgical procedure and post surgery, said garment configured for use on a patient having a chest, a first breast, a second breast, a first shoulder, a second shoulder, a first hand, and a second hand, comprising:

(a) a support band made of elastic material, including,
  (i) a proximal end,
  (ii) a distal end,
  (iii) a broadened section proximate said distal end,
  (iv) an outward facing surface including a loop covering,
  (v) an inward facing surface, (vi) a pocket proximate said distal end on said outward facing surface, said pocket configured to receive at least a portion of one of said hands of said patient user, (vii) a first cup formed in said broadened section proximate said distal end, said first cup configured to receive said first breast, (viii) a second cup formed in said broadened section between said first cup and said proximal end, said second cup configured to receive said second breast, and (ix) a first hook panel located on said inward facing surface of said support band proximate said distal end;

(b) a grip panel, including (i) an outward facing surface having a loop covering, (ii) an inward facing surface having a second hook panel, and (iii) a strap loop;

(c) said grip panel being connected to said proximal end of said support band by an engagement between said second hook panel on said grip panel and said loop covering on said outward facing surface of said support band, said grip panel being oriented so that said strap loop lies distal to said pocket on said support band; and (d) wherein said support band is configured to form into a loop encircling said chest of said patient user by engaging said first hook panel on said inward facing surface of said support band to said loop covering on said outward facing surface of said support band or said loop covering on said outward facing surface of said grip panel.

2. The support garment as recited in claim 1, wherein:

(a) said proximal end of said support band is configured to be cut to any desired length, thereby forming a new position for said proximal end of said support band; and (b) said grip panel is configured to be placed proximate said new position for said proximal end of said grip panel by an engagement between said second hook panel on said grip panel and said loop covering on said outward facing surface of said support band.

3. The support garment as recited in claim 1, further comprising:

(a) a first relief notch proximate said first cup, said first relief notch including a first pair of lateral edges;

(b) a second relief notch proximate said first cup, said second relief notch including a second pair of lateral edges;

(c) a third relief notch proximate said second cup, said third relief notch including a third pair of lateral edges;

(d) a fourth relief notch proximate said second cup, said fourth relief notch including a fourth pair of lateral edges;

(e) wherein said first pair of lateral edges are joined together;

(f) wherein said second pair of lateral edges are joined together;

(g) wherein said third pair of lateral edges are joined together; and (h) wherein said fourth pair of lateral edges are joined together.

4. The support garment as recited in claim 3, wherein said joining of said pairs of lateral edges is accomplished by stitching.

5. The support garment as recited in claim 3, further comprising:

(a) a center relief in the form of a slit located between said first and second cups, said center relief including a fifth pair of lateral edges; and (b) wherein said fifth pair of lateral edges are joined together.

6. The support garment as recited in claim 1, further comprising:

(a) a strap assembly, including, (i) a first strap having an outward facing surface with a loop covering, (ii) a second strap having an outward facing surface with a loop covering, (iii) a first hook panel, and (iv) a second hook panel;

(b) said strap assembly being configured to releasably attach to said outward facing surface on said support band by an engagement between said first hook panel, said first strap, and said support band; and (c) said strap assembly being configured to releasably attach to said outward facing surface on said support band by an engagement between said second hook panel, said second strap, and said support band.

7. The support band as recited in claim 6, further comprising:

(a) said strap assembly further including, (i) a third strap having an outward facing surface with a loop covering, (ii) a fourth strap having an outward facing surface with a loop covering, (iii) a third hook panel, and (iv) a fourth hook panel;

(b) said strap assembly being configured to releasably attach to said outward facing surface on said support band by an engagement between said third hook panel, said third strap, and said support band; and (c) said strap assembly being configured to releasably attach to said outward facing surface on said support band by an engagement between said fourth hook panel, said fourth strap, and said support band.

8. The support band as recited in claim 6, wherein said first and second straps are configured to be cut to a desired length in order to fit said patient user.

9. The support band as recited in claim 8, wherein said first hook panel and said second hook panel are detachable so that they can be placed on a newly cut proximal end.

10. The support band as recited in claim 1 wherein said support band is made of elastic material configured to stretch in two perpendicular directions.

11. A support garment suitable for use in a surgical procedure and post surgery, said garment configured for use on a patient having a chest, a left breast, a right breast, a left shoulder, a right (a) a support band made of elastic material, including, (i) a proximal end, (ii) a distal end, (iii) a broadened section proximate said distal end, (iv) an outward facing surface including a loop covering, (v) an inward facing surface, (vi) a pocket proximate said distal end of said outward facing surface, said pocket configured to receive at least a portion of said user's right hand, (vii) a left cup formed in said broadened section proximate said distal end, said left cup configured to receive said left breast, (viii) a right cup formed in said broadened section between said left cup and said proximal end, said right cup configured to receive said right breast, and (ix) a first hook panel located on said inward facing surface of said support band proximate said distal end;

(b) a grip panel, including (i) an outward facing surface having a loop covering, (ii) an inward facing surface having a second hook panel, and (iii) a strap loop;

(c) said grip panel being connected to said proximal end of said support band by an engagement between said second hook panel on said grip panel and said loop covering on said outward facing surface of said support band, said grip panel being oriented so that said strap loop lies distal to said pocket on said support band, with said strap loop being configured to receive said user's left thumb; and (d) wherein said support band is configured to form into a loop encircling said chest of said user by engaging said first hook panel on said inward facing surface of said support band to said loop covering on said outward facing surface of said support band or said loop covering on said outward facing surface of said grip panel.

12. The support garment as recited in claim 11, wherein:

(a) said proximal end of said support band is configured to be cut to any desired length, thereby forming a new position for said proximal end of said support band; and (b) said grip panel is configured to be placed proximate said new position for said proximal end of said grip panel by an engagement between said second hook panel on said grip panel and said loop covering on said outward facing surface of said support band.

13. The support garment as recited in claim 11, further comprising:

(a) a first relief notch proximate said left cup, said first relief notch including a first pair of lateral edges;

(b) a second relief notch proximate said left cup, said second relief notch including a second pair of lateral edges;

(c) a third relief notch proximate said right cup, said third relief notch including a third pair of lateral edges;

(d) a fourth relief notch proximate said right cup, said fourth relief notch including a fourth pair of lateral edges;

(e) wherein said first pair of lateral edges are joined together;

(f) wherein said second pair of lateral edges are joined together;

(g) wherein said third pair of lateral edges are joined together; and (h) wherein said fourth pair of lateral edges are joined together.

14. The support garment as recited in claim 13, wherein said joining of said pairs of lateral edges is accomplished by stitching.

15. The support garment as recited in claim 13, further comprising:

(a) a center relief in the form of a slit located between said left and right cups, said center relief including a fifth pair of lateral edges; and (b) wherein said fifth pair of lateral edges are joined together.

16. The support garment as recited in claim 11, further comprising:

(a) a strap assembly, including, (i) a first strap having an outward facing surface with a loop covering, (ii) a second strap having an outward facing surface with a loop covering, (iii) a first hook panel, and (iv) a second hook panel;

(b) said strap assembly being configured to releasably attach to said outward facing surface on said support band by an engagement between said first hook panel, said first strap, and said support band; and (c) said strap assembly being configured to releasably attach to said outward facing surface on said support band by an engagement between said second hook panel, said second strap, and said support band.

17. The support band as recited in claim 16, further comprising:

(a) said strap assembly further including, (i) a third strap having an outward facing surface with a loop covering, (ii) a fourth strap having an outward facing surface with a loop covering, (iii) a third hook panel, and (iv) a fourth hook panel;

(b) said strap assembly being configured to releasably attach to said outward facing surface on said support band by an engagement between said third hook panel, said third strap, and said support band; and (c) said strap assembly being configured to releasably attach to said outward facing surface on said support band by an engagement between said fourth hook panel, said fourth strap, and said support band.

18. The support band as recited in claim 16, wherein said first and second straps are configured to be cut to a desired length in order to fit said patient user.

19. The support band as recited in claim 18, wherein said first hook panel and said second hook panel are detachable so that they can be placed on a newly cut proximal end.

20. The support band as recited in claim 11 wherein said support band is made of elastic material configured to stretch in two perpendicular directions.

* * * * *